US010021746B2

(12) United States Patent
Hilgers

(10) Patent No.: US 10,021,746 B2
(45) Date of Patent: Jul. 10, 2018

(54) LED LIGHTING CIRCUIT WITH CONTROLLABLE LED MATRIX

(71) Applicant: KONINKLIJKE PHILIPS N.V., Eindhoven (NL)

(72) Inventor: Achim Hilgers, Aachen (DE)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 15/555,541

(22) PCT Filed: Feb. 29, 2016

(86) PCT No.: PCT/EP2016/054222

§ 371 (c)(1),
(2) Date: Sep. 4, 2017

(87) PCT Pub. No.: WO2016/142198

PCT Pub. Date: Sep. 15, 2016

(65) Prior Publication Data

US 2018/0049284 A1 Feb. 15, 2018

(30) Foreign Application Priority Data

Mar. 9, 2015 (EP) ..... 15158216

(51) Int. Cl.
*H05B 33/08* (2006.01)

(52) U.S. Cl.
CPC ..... *H05B 33/0824* (2013.01)

(58) Field of Classification Search
CPC H05B 33/08; H05B 33/0806; H05B 33/0824; G09G 3/32; G09G 3/3325; G09G 3/3233
(Continued)

(56) References Cited

U.S. PATENT DOCUMENTS 8,207,685 B2 * 6/2012 Cheng ..... H05B 33/0824 315/185 R
8,686,651 B2 * 4/2014 Lynch ..... H05B 33/0818 315/192

(Continued)

FOREIGN PATENT DOCUMENTS

EP 2533307 A1 12/2012
WO 20100013177 A1 2/2010

(Continued)

OTHER PUBLICATIONS

EPO as ISA, "International Search Report and Written Opinion" dated Jun. 17, 2016 from International Application No. PCT/EP2016/054222, filed Feb. 29, 2016, 13 pages.

(Continued)

*Primary Examiner* — Jason M Crawford
(74) *Attorney, Agent, or Firm* — Brian D. Ogonowsky; Patent Law Group LLP

(57) ABSTRACT

A circuit and a method for operating LED lighting devices are described. A first LED lighting device and a second LED lighting device are electrically connected in series between first and second lighting circuit terminals. A third lighting circuit terminal is connected between the first and second LED lighting devices. A power supply with a first and second power supply terminals for delivering electrical power to the LED lighting devices is provided. Further, a switching circuit comprises at least a first switching element and second switching element. The first switching element is connected between the first power supply terminal and the first lighting circuit terminal. The second switching element is connected between the first power supply terminal and the third lighting circuit terminal. The switching circuit receives switching signals sw1, sw2 from a control circuit.

13 Claims, 6 Drawing Sheets

(58) Field of Classification Search
USPC ..... 315/185 R, 191–192
See application file for complete search history.

(56) References Cited

U.S. PATENT DOCUMENTS

| | | | | |
|---|---|---|---|---|
| 9,661,696 | B1 * | 5/2017 | Chen | H05B 33/0812 |
| 2005/0151889 | A1 * | 7/2005 | Moon | H05B 33/0803 349/19 |
| 2006/0038758 | A1 * | 2/2006 | Routley | G09G 3/3233 345/81 |
| 2006/0232219 | A1 * | 10/2006 | Xu | H05B 33/0809 315/209 R |
| 2007/0236430 | A1 * | 10/2007 | Fish | G09G 3/3233 345/82 |
| 2009/0135166 | A1 * | 5/2009 | Uchino | G09G 3/006 345/205 |
| 2010/0141630 | A1 * | 6/2010 | Kimura | G09G 3/3233 345/211 |
| 2011/0133658 | A1 * | 6/2011 | Sauerlaender | H05B 33/0824 315/192 |
| 2011/0273103 | A1 * | 11/2011 | Hong | H05B 33/0809 315/193 |
| 2013/0193852 | A1 | 8/2013 | Frattini et al. | |
| 2015/0061499 | A1 * | 3/2015 | Hattrup | H05B 33/0815 315/122 |
| 2015/0195874 | A1 * | 7/2015 | Kang | H05B 33/083 315/192 |
| 2016/0019836 | A1 * | 1/2016 | Qing | G09G 3/3233 345/76 |
| 2016/0174315 | A1 * | 6/2016 | Chang | H05B 33/0824 315/191 |
| 2016/0360586 | A1 * | 12/2016 | Yang | H05B 33/0815 |

FOREIGN PATENT DOCUMENTS

| | | | |
|---|---|---|---|
| WO | 2013090945 | A1 | 6/2013 |
| WO | 20140153678 | A1 | 10/2014 |

OTHER PUBLICATIONS

Extended European Search Report dated Sep. 22, 2015 from European Patent Application No. 15158216.0 filed Mar. 9, 2015, 8 pages.

* cited by examiner

LED LIGHTING CIRCUIT WITH CONTROLLABLE LED MATRIX

CROSS-REFERENCE TO RELATED APPLICATIONS

The present application is a § 371 application of International Application No. PCT/EP2016/054222 filed on Feb. 29, 2016 and titled "LED LIGHTING CIRCUIT WITH CONTROLLABLE LED MATRIX," which claims the benefit of European Patent Application No. 15158216.0 filed on Mar. 9, 2015. International Application No. PCT/EP2016/054222 and European Patent Application No. 15158216.0 are incorporated herein.

FIELD OF THE INVENTION

The invention relates to a circuit for operating LED lighting devices, to a lighting device including such a circuit, and to a method of operating LED lighting devices.

BACKGROUND OF THE INVENTION

In an increasing number of lighting applications, LED lighting devices are used. In many of these applications, multiple LED lighting devices are employed, e.g. in the form of an array. Some applications require controllable LED lighting devices within the array.

US 2013/0193852 A1 describes a circuit for controlling a plurality of LEDs connected in series. The circuit includes a plurality of switches, each connectable between the anode and cathode of one of the LEDs. Each of the switches has a conducting and non-conducting state. Controllers operate the switches, such that open switches turn on their associated LEDs and closed switches will turn off their associates LEDs. Several circuits may be connected together in order to control an array of LEDs.

Known arrays of individually controllable LEDs may require an extensive amount of wiring to connect to each of the LEDs. This may be an obstacle for dense packaging of the LED lighting devices.

SUMMARY OF THE INVENTION

It may be considered an object to propose a circuit and a method for operating LED lighting devices, especially suited for dense packaging.

This object is solved by a circuit according to claim 1, a lighting device according to claim 14 and a method according to claim 15. Dependent claims refer to preferred embodiments of the invention.

The circuit according to the invention comprises at least a lighting circuit with a first and a second LED lighting device, a power supply for delivering electrical power to the LED lighting devices and a switching circuit connected to the lighting circuit and to the power supply for selectively connecting the LED lighting devices to electrical power.

In the present context, the term "LED lighting device" refers to any type of electrical component or electrical circuit including at least one solid-state light source. The one or more solid-state light sources in each LED lighting device may be any type, such as in particular LEDs, organic LEDs (OLED) or polymer light-emitting diodes (PLED). Each of the first and second LED lighting devices is preferably of two-lead type, i.e. has two terminals, anode and cathode. Internally, each LED lighting device may be comprised of a single component, e.g. a single semiconductor LED only, or may alternatively be comprised of two, three or more individual components, e.g. semiconductor LEDs, electrically connected in series, in parallel or in any series/parallel configuration.

According to the invention, the first and second LED lighting devices of the lighting circuit are electrically connected in series between a first and second lighting circuit terminal. Preferably, the LED lighting devices are connected with the same polarity, i.e. a cathode terminal of the first LED lighting device is connected to an anode terminal of the second LED lighting device or vice versa. The lighting circuit further comprises a third terminal connected between the first and second LED lighting devices, preferably to the cathode of the first LED lighting device and to the anode of the second LED lighting device.

The power supply comprises at least a first and a second power supply terminal. Preferably, the power supply may be a constant current source. The power supply may be provided only for the first and second LED lighting device (which may be referred to as a sub-string), but may also supply electrical power to additional LED lighting devices, in particular to additional sub-strings.

While the power supply may be bi-polar, the invention may also be realized with a unipolar power supply, i.e. capable of delivering electrical power with a single polarity only.

The circuit according to the invention further comprises a switching circuit with at least a first and a second switching element. The term "switching element" here refers to any circuit or component controllable to be rendered either conductive, i.e. providing low resistance between two terminals, or non-conducting, i.e. by providing high resistance between the two terminals. Examples of controllable switching elements are e.g. relays, but electronic switching elements like transistors or MOSFETs are preferred.

The switching circuit is connected to the power supply and to the lighting circuit such that the first switching element is connected between the first power supply terminal and the first lighting circuit terminal and the second switching element is connected between the first power supply terminal and the third lighting circuit terminal.

The circuit thus allows to selectively supply electrical power to the first and second LED lighting devices. For example, both the first and second LED lighting devices may be turned off (e.g. by setting both the first and second switching element to a non-conductive state), or both the first and second LED lighting devices may be turned on (e.g. by setting the first switching element to a conductive state and second switching element to a non-conductive state). Also, it is possible to only activate the second LED lighting device while deactivating the first LED lighting device, e.g. by rendering the second switching element conductive, irrespective of the state of the first switching element.

In order to close the electrical circuit, the second lighting circuit terminal may be connected directly or indirectly to the power supply, in particular to the second power supply terminal.

It is thus possible to achieve different activation patterns of the sub-string comprising the first and second LED lighting devices with a simple switching circuit and with a minimum of electrical leads to the lighting circuit. As will become apparent in connection with preferred embodiments, this is particularly advantageous for a plurality of LED lighting devices in which individual activation patterns should be achieved, and especially with densely arranged LED lighting devices, for example, arrays of LED lighting devices.

In a preferred embodiment of the invention, the switching circuit comprises a third switching element connected between the second power supply terminal and third lighting circuit terminal. A corresponding switching circuit with a first, second and third switching element in the above described configuration allows fully individual activation patterns, i.e. each of the first and second LED lighting devices may be individually turned on or off irrespective of activation of the other LED lighting device. In particular, in addition to the above described switching states, the first LED lighting device may be activated and second LED lighting device deactivated by rendering the first and third switching element conductive and second switching element non-conductive. Thus, with a switching circuit comprising at least the above described three switching elements, all possible activation patterns may be achieved for the sub-string comprising the first and second LED lighting device. For multiple of such sub-strings, each comprising at least two LED lighting devices, fully individual activation patterns may be achieved already with three switching elements per sub-string.

In a further preferred embodiment of the invention, at least two of the above described sub-string circuits are combined, namely at least a first and a second sub-string, each comprising a lighting circuit with at least two LED lighting devices and a switching circuit with at least two, preferably at least three switching elements as described above. Preferably, the second lighting circuit terminals of both the first and second sub-strings are connected to a common power supply terminal, in particular to the second power supply terminal. Further preferred, the common terminal may be a ground terminal. Alternatively, the polarity may be reversed so that the common terminal may be a supply voltage terminal, at which a voltage is applied, e. g. connected to a DC power supply.

The arrangement of two or more sub-strings, preferably of identical structure, allows to place a relatively large number of LED lighting devices closely together with a minimum of wiring required. While the arrangement of the LED lighting devices may in principle be arbitrary, it is particularly preferred to arrange the first and second LED lighting devices of the first sub-string and the first and second LED lighting devices of the second sub-string arranged geometrically in a line. For example, two-sub-strings comprising in total at least four LED lighting devices arranged in a line may form a column of a matrix of LED lighting devices. The four lighting devices and corresponding switching circuits may be commonly referred to as a string. Preferably, the arrangement may be symmetrical to a central common terminal, i.e. where the second lighting circuit terminals of both sub-strings are connected, especially preferred to common ground or common supply voltage, depending on the chosen polarity.

In one preferred embodiment of the invention, a plurality of LED lighting devices, which include at least the first and second LED lighting devices, are arranged in a matrix, forming a plurality of rows and columns of controllable lighting devices. The LED lighting devices may be arranged on a common carrier or substrate and arranged closely together. The rows and columns may be arranged at right angles to another. Preferably, each column comprises at least two controllable LED lighting devices in one sub-string, further preferred at least four LED lighting devices in a string comprised of two sub-strings. Further preferred, the LED lighting devices are preferably individually controllable, so that any desired activation pattern may be achieved, especially preferred where each individual LED lighting device may be activate or deactivated independent of the activation or deactivation of any of the other LED lighting devices in the matrix.

It may be especially preferred if the matrix comprises at least two parallel columns of LED lighting devices, each arranged in a line, i.e. forming at least two parallel lines of LED lighting devices. Each of the columns may comprise a string, i.e. at least two sub-strings, each comprising a lighting circuit connected to a switching circuit as described above. Particularly preferred, the second lighting circuit terminals of the lighting circuit of the two or more columns are connected to a common power supply terminal, especially the second power supply terminal, which may e.g. be a ground or supply voltage terminal.

In preferred embodiments of the invention, a control circuit may be provided for delivering switching signals to the switching circuit. Thus, the control circuit may provide signals to the switching elements to achieve a desired activation pattern of the LED lighting devices. There may be individual control circuits provided for each string or sub-string, or one control circuit may provide multiple strings or sub-strings. In particular, the control circuit may comprise a microcontroller, microprocessor, signal processor or other component for executing a control program.

While the control circuit may directly generate each individual switching signal for each of the switching devices, preferred embodiments provide a logic circuit for delivering switching signals based on input signals. One such logic circuit may deliver switching signals for at least a sub-string comprising a first and second LED lighting device as described above.

In particular, a first input signal may be provided to indicate an activation or deactivation state of the first LED lighting device, and a second input signal may be provided for the second LED lighting device in the same manner. A logic circuit may be disposed to deliver switching signals at least to the first and second switching elements, preferably also to the third switching element, to activate the first and second LED lighting devices in accordance with the first and second input signals. Thus, individual control of the activation state of the LED lighting devices by the control circuit is facilitated. A logic circuit may be implemented by a digital or analogue circuit.

In one embodiment, the logic circuit is disposed to operate the switching elements depending on the input signals such that $$sw1=L1$$

$$sw2=L2 \text{ AND } (\text{NOT } L1 \text{ OR NOT } L2)$$

$$sw3=L1 \text{ AND } (\text{NOT } L2),$$

wherein sw1 is indicative of the open (i.e. non-conductive)/closed (i.e. conductive) state of the first switching element, sw2 is indicative of an open/closed state of the second switching element, and sw3 is indicative of an open/closed state of the third switching element. L1 is used to signify an active/inactive state of the first input signal and L2 is the same for the second input signal.

In an alternative embodiment, the logic circuit may be disposed to operate the switching elements by providing switching signals sw1, sw2, and sw3 as defined above depending on the input signals L1 and L2 as defined above such that $sw1=L1$ $sw2=L2$ AND (NOT $L1$)

$sw3=$NOT $L2$.

The above described circuit may be used in a lighting device, in particular a matrix lighting device with a plurality of LED lighting devices arranged to allow different activation patterns. Preferably, the lighting device includes optical means for projecting or reflecting light emitted from the LED lighting devices to form an illumination pattern. The optical means may be individual optical means for each LED lighting device (e.g. individual reflectors, lenses or other optical elements at each LED lighting device) or common optical means (i.e. a reflector, lens or other optical component) arranged for forming an illumination pattern of two, more or even all LED lighting devices of the circuit.

The lighting device according to this aspect of the invention is in particular suited as a front lighting device for an automobile. Use of different activation patterns in this context, in particular fully individual activation patterns for each LED lighting device, may for example be used for adaptive headlamps to vary beam patterns and intensity. For example, it is possible to operate a plurality of LED lighting devices, in particular a matrix of LED lighting devices as described above, with selective illumination areas, e.g. reduced or even deactivated illumination in one zone simultaneous with full illumination in other zones, etc.

In the control method according to the invention, the above described lighting circuit is operated by supplying electrical power through the above described switching circuit.

These and other aspects of the invention will be apparent from and elucidated with reference to the embodiments described hereinafter.

DETAILED DESCRIPTION OF EMBODIMENTS

Figure 1A:
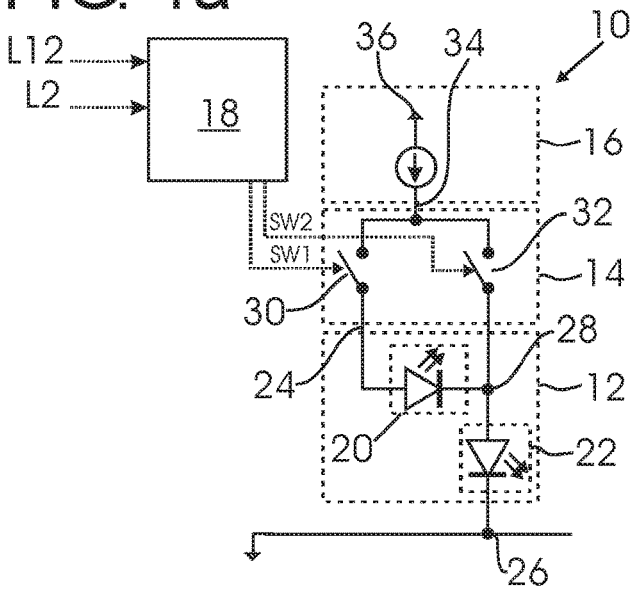
FIGS. 1*a*, 1*b* show partly symbolical circuit diagrams of a first and second embodiment of a circuit.

FIG. 1*a* shows a first circuit 10 according to a first embodiment comprising a lighting circuit 12, a switching circuit 14, a power supply 16 and a logic circuit 18.

The lighting circuit 12 comprises two LED lighting devices, a first LED lighting device 20 and a second LED lighting device 22, connected in series with a cathode of the first LED lighting device 20 connected to an anode of the second LED lighting device 22.

The lighting circuit 12 comprises three external terminals: A first lighting circuit terminal 24 connected to an anode of the first LED lighting device 20, a second lighting circuit terminal 26 connected to ground and third lighting terminal 28 connected in between the first and second LED lighting devices 20, 22, i.e. both to a cathode of the first LED lighting device 20 and an anode of the second LED lighting device 22.

Figure 2A:
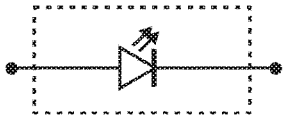
FIG. 2*a*-2*c* show exemplary embodiments of LED lighting devices of the circuits of FIGS. 1*a*, 1*b;*
Figure 2B:
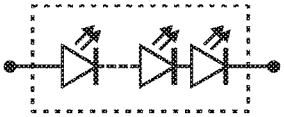
Figure 2C:
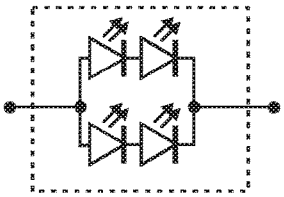

The LED lighting devices 20, 22 are symbolically shown in FIG. 1*a* as single LED elements with two terminals, an anode and a cathode. FIG. 2*a*-2*c* show different exemplary embodiments of LED lighting devices comprised either of a single LED element (FIG. 2*a*) which could be for example a semiconductor LED, OLED, etc., or of a series connection of individual LEDs (FIG. 2*b*) or even a parallel/series connection as shown in FIG. 2*c*.

The lighting circuit 12 is connected to the switching circuit 14 only by two separate electrical leads, namely at the first lighting circuit terminal 24 and third lighting circuit terminal 28. In addition, lighting circuit 12 is connected to ground at the second lighting circuit terminal 26. There are no further electrical connections necessary, which, as will become apparent later, can be advantageous for close arrangement of a plurality of LED lighting devices.

The switching circuit 14 comprises, in the first embodiment shown, two switching elements, namely a first switching element 30 and second switching element 32. The switching elements 30, 32 are schematically shown as switches controlled by switching control signals sw1, sw2. In different realizations of the switching circuit 14, the switching elements 30, 32 may e.g. be transistors or MOSFETs.

The power supply 16 is in the present example shown symbolically as a constant current source with a first power supply terminal 34 connected to the switching circuit 14 and a second power supply terminal 36 connected to ground.

The first switching element 30 is connected between the first power supply terminal 34 and the first lighting circuit terminal 24. The second switching element 32 is connected between the first power supply terminal 34 and the third lighting circuit terminal 28.

The activation pattern of the LED lighting devices 20, 22 of the lighting circuit 12 may be determined by the switching state of the switching elements 30, 32. If both switching elements 30, 32 are open, none of the LED lighting devices 20, 22 is activated. If only the first switching element 30 is closed but second switching element 32 is open, both LED lighting devices 20, 22 are activated. If the second switching element 32 is closed, only the second LED lighting device 22 is activated and the first LED lighting device 20 deactivated, regardless of the state of the first switching element 30.

Thus, depending on the switching state of the switching circuit 14, which in turn depends on the switching control signals sw1, sw2, either none of the LED lighting devices 20, 22, both or only the second LED lighting device 22 may be activated.

The switching control signals sw1, sw2 are delivered by a logic circuit 18 in response to logic input signals L12 (determining whether both the first and second LED lighting devices 20, 22 should be activated) and L2 (determining whether the second LED lighting device 22 should be activated individually). The logic circuit 18 in this example is straightforward and may determine appropriate switching control signals sw1, sw2 according to logical equations as follows:

$sw1=L12$ $sw2=L2$

Figure 1B:
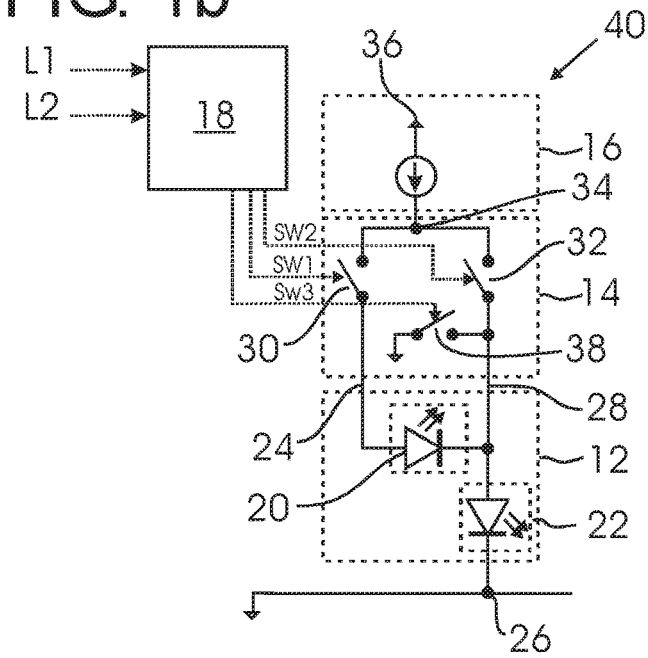

FIG. 1*b* shows a second, further preferred embodiment of a circuit 40. The circuit 40 according to the second embodiment largely corresponds to the circuit 10 of the first embodiment described above. Therefore, only differences will be further explained. Like parts will be designated by like reference numerals.

In the circuit 40, the switching circuit 14 comprises a third switching element 38, connected between the third lighting circuit terminal 28 and ground, corresponding both to the second power supply terminal 36 and the second lighting circuit terminal 26. As a further development of the switching circuit 14 according to FIG. 1*a*, the switching circuit 14 according to FIG. 1*b* allows fully individual activation patterns of the LED lighting devices 20, 22 of the lighting circuit 12, i.e. each of the LED lighting devices may be individually activated or deactivated regardless of the state of another LED lighting device. The activation state of the first LED lighting device 20 (L1) and of the second LED lighting device 22 (L2) depends on the switching state of the first, second and third switching element 30, 32, 38, represented by their switching control signal sw1, sw2, sw3 according to the following logical equation system:

$$L1 = sw1 \text{ AND } sw3 \text{ AND NOT } sw2$$

$$L2 = sw2 \text{ AND NOT } sw3$$

$$L1 \text{ AND } L2 = sw1 \text{ AND NOT } sw3 \text{ AND NOT } sw2.$$

The logic circuit 18 in the circuit 40 according to FIG. 1*b* receives commands according to the desired activation states L1, L2 of the first and second LED lighting devices 20, 22 as input signals and determines the switching control signals sw1, sw2, and sw3 accordingly. The behaviour may be summarized by the following truth table (wherein "0" means off/open, "1" means on/closed, "x" means any state):

| L2 | L1 | sw3 | sw2 | sw1 |
|---|---|---|---|---|
| 0 | 0 | x | 0 | 0 |
| 0 | 1 | 0 | 0 | 1 |
| 1 | 0 | 0 | 1 | x |
| 1 | 1 | 1 | 0 | 1 |

Thus, the switching signals may be determined by the following logical equation system:

$$sw1 = L1$$

$$sw2 = L2 \text{ AND NOT } L1$$

$$sw3 = L1 \text{ AND } L2$$

The logic circuit 18 working according to this equation system may be realized by digital logic, either in the form of discrete digital components or implemented as software-code, e.g. in a microcontroller.

Figure 5A:
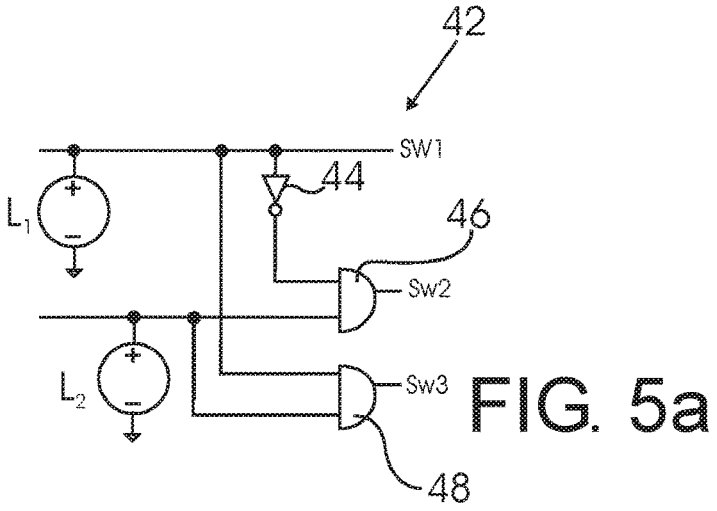
FIGS. 5*a*-5*e* show different embodiments of logic circuits.

FIG. 5*a* shows an exemplary embodiment of a logic circuit 42 implementing this behaviour, including a NOT gate 44 and two AND gates 46, 48.

Figure 3A:
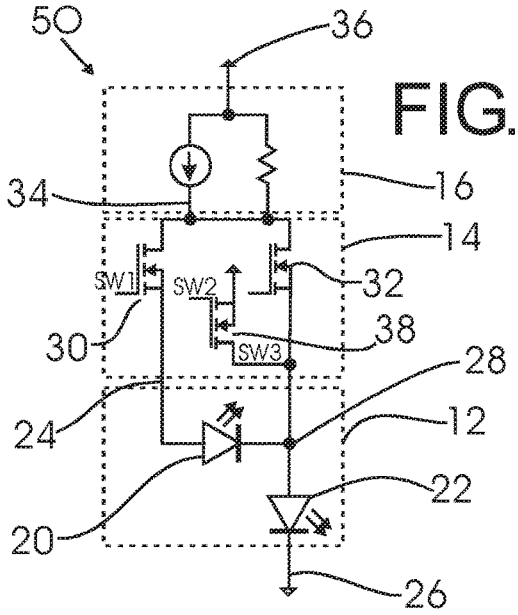
FIGS. 3*a*-3*c* show circuit diagrams of a first, second and third more detailed embodiment of the circuit of FIG. 1*b;*

FIG. 3*a* shows an exemplary embodiment of a circuit 50 as one possible realization of the switching circuit 14, lighting circuit 12 and power supply 16 of FIG. 1*b*. The first, second and third switching elements 30, 32, 38 are here realized by MOSFETs, where the switching signals sw1, sw2, and sw3 are delivered to the gates of the MOSFETs.

The logic circuit 42 according to FIG. 5*a* and the circuit 50 of FIG. 3*a* may be used in combination to realize the circuit shown more schematically in FIG. 1*b*.

Figure 5B:
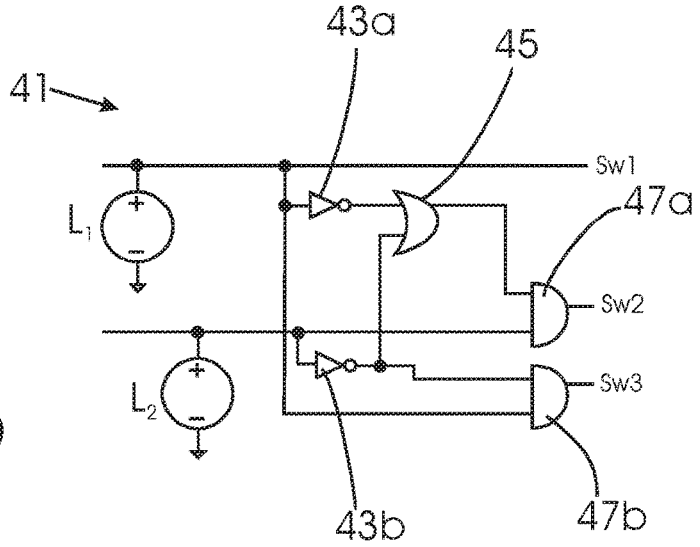

FIG. 5*b* shows an alternative embodiment of a logic circuit 41, comprising NOT gates 43*a*, 43*b*, OR gate 45 and two AND gates 47*a*, 47*b* to obtain the switching control signals sw1, sw2, sw3 from the desired activation states L1, L2. The circuit 41 according to FIG. 5*b* may be used for driving the switching elements 30, 32, 38 in the circuit 50 according to FIG. 3*a*.

Figure 3B:
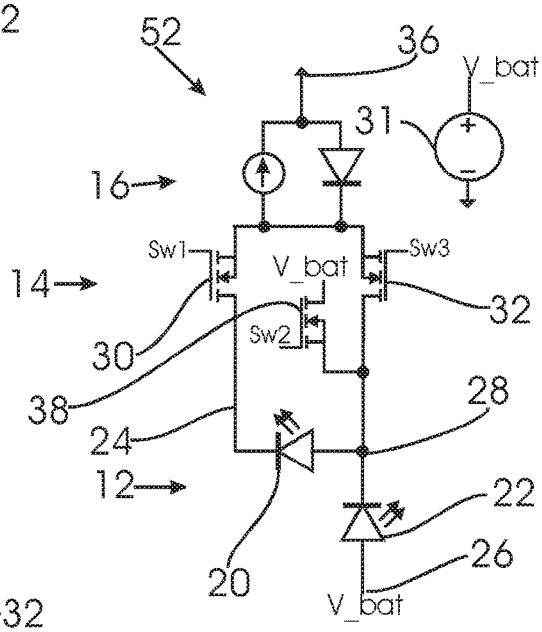

In an alternative embodiment of a circuit 52, shown in FIG. 3*b*, the polarity is reversed. In comparison to the circuit 50 of FIG. 3*a*, the LED lighting devices 20, 22 have inverted polarity. The second lighting circuit terminal 26 is connected to operating voltage $V_{bat}$ delivered by a DC voltage source 31. The second switching element 38 is connected the third lighting terminal 28 and operating voltage $V_{bat}$. A constant current source 33 regulates the current through the LED lighting devices 20, 22 to a suitable operation current.

Figure 5C:
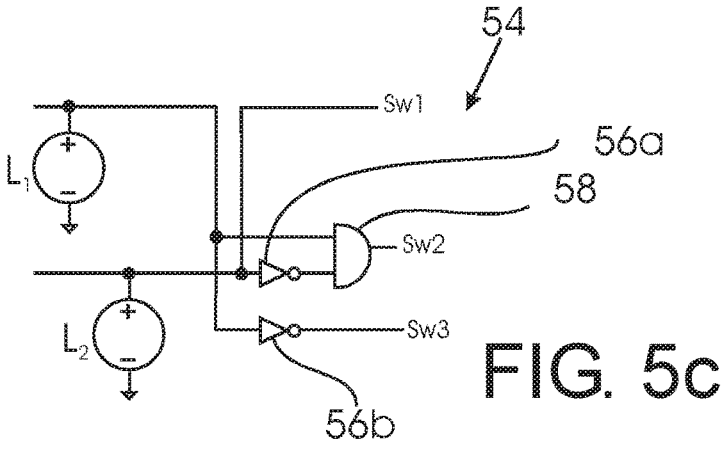

FIG. 5*c* shows a logic circuit 54 to generate the switching control signals sw1, sw2, sw3 from the desired activation states L1, L2. The logic circuit 54 is a digital circuit including NOT gates 56*a*, 56*b* and an AND gate 58. The logic circuit 54 of FIG. 5*b* and the circuit 52 of FIG. 3*b* may be used in combination to achieve the desired activation state L1, L2 of the LED lighting devices 20, 22.

Figure 3C:
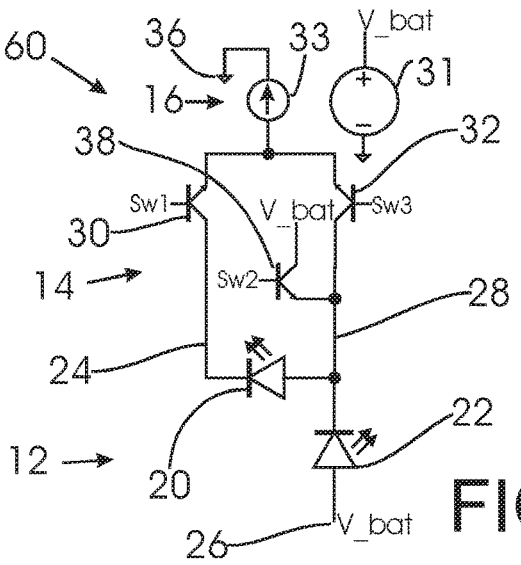

FIG. 3*c* shows yet another embodiment of a circuit 16 as one possible embodiment of the more general circuit of FIG. 1*b*, including a power supply 16, switching circuit 14 and lighting circuit 12. As the circuit 60 according to FIG. 3*c* is a further variant of the same circuit structure as explained above, only specifics and differences will be further explained.

In the circuit 60 according to FIG. 3*c*, polarity is again reversed with respect to the circuit of FIG. 1*b*, i.e. polarity of the LED lighting devices 20, 22 of the lighting circuit 12 is reversed, in the same way as in the circuit 52 of FIG. 3*b*. Operating power is delivered by a voltage source 31. A constant current source 33 serves to deliver a current suited for operation of the LEDs 20, 22.

Further, in the circuit 60 according to FIG. 3*c*, the switching elements 30, 32, 38 are realized as bipolar transistors. Switching signals sw1, sw2, sw3 are delivered to the base terminals of transistors 30, 32, 38.

Figure 5D:
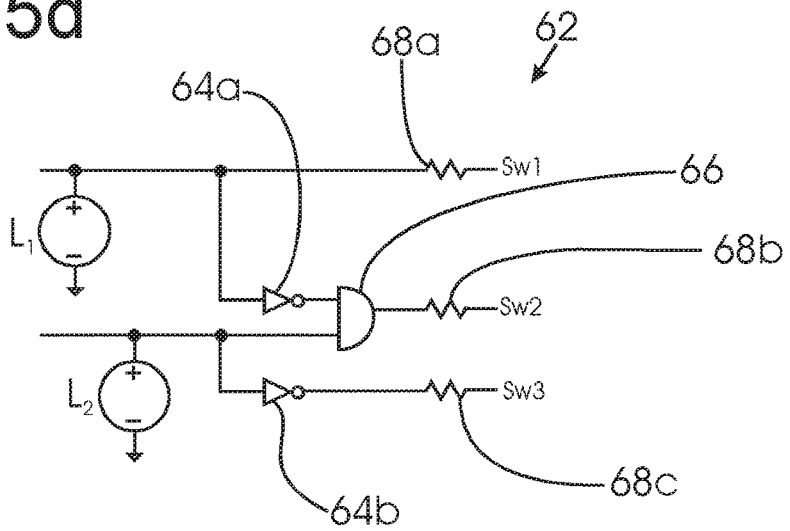

FIG. 5*d* shows a circuit 62 as one possible embodiment of a logic circuit for driving the circuit 60 according to FIG. 3*c*. In the circuit 62, the switching signals sw1, sw2, sw3 are derived from the desired activation states L1, L2 by a logic network comprising NOT gates 64*a*, 64*b* and an AND gate 66. For driving the bipolar transistors 30, 32, 38 of FIG. 3*c*, resistors 68*a*, 68*b*, 68*c* are provided.

Figure 5E:
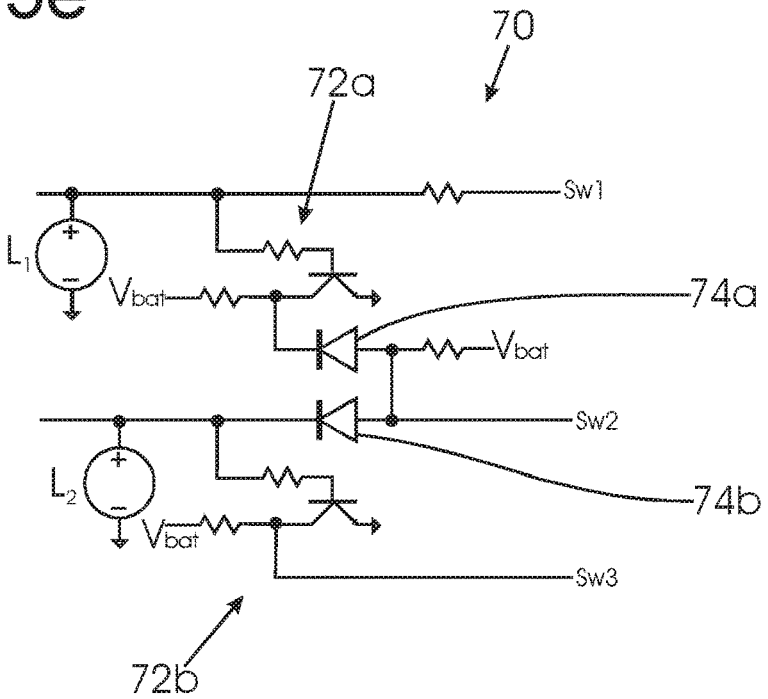

FIG. 5*e* shows a circuit 70 as a still further embodiment of a logic circuit for delivering switching signals sw1, sw2, sw3 derived from desired activation states L1, L2 for driving the bipolar transistors 30, 32, 38 in the circuit 60 (FIG. 3*c*). In order to reduce cost and size, the circuit 70 is realized in a fully analog way as shown in FIG. 5*e*, where NOT gates are realized by inverting transistor stages 72*a*, 72*b* and an AND gate by two diodes 74*a*, 74*b*.

Figure 6:
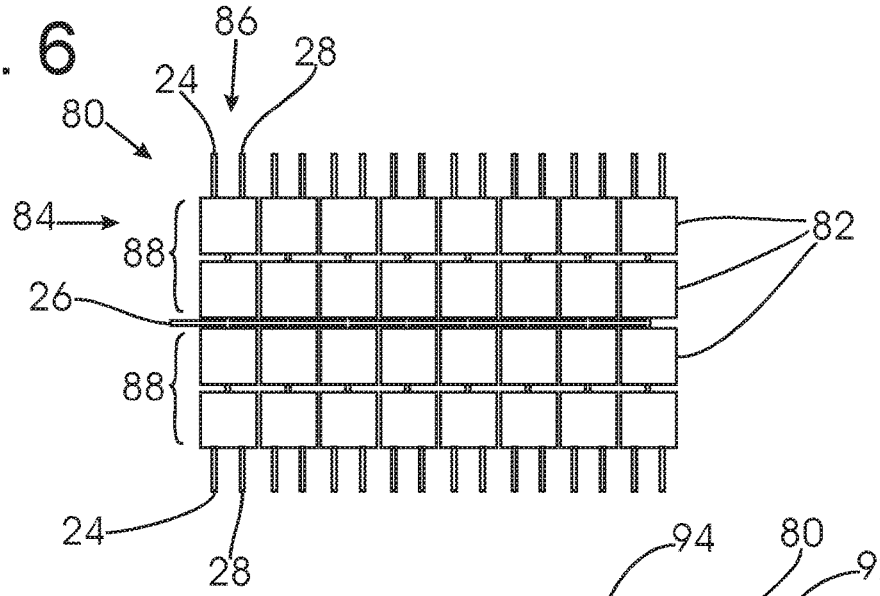
FIG. 6 shows a partly symbolical view of LED lighting elements arranged in a matrix.

The above described circuits according to the general structure of the circuit 10 (FIG. 1*a*) or 40 (FIG. 1*b*) may be used in lighting devices comprising a plurality of LED lighting devices arranged closely together, in particular in a matrix configuration as shown in FIG. 6. Here, a matrix lighting device 80 is comprised of a plurality of LED lighting devices 82 arranged closely together to from rows 84 and columns 86.

The exemplary matrix 80 shown in FIG. 6 comprises eight columns 86 of four LED lighting devices 82 each. As the skilled person will realize, the number of columns for a specific application may be chosen freely, such that a 4× n-matrix is achieved.

The LED lighting devices 82 of the matrix lighting device 80 are interconnected to form sub-strings of two LED lighting devices. Each column 86 of LED lighting devices 82 comprises two sub-strings 88 connected to a common central terminal 26. Each column, or string, 86 comprises two individual terminals 24, 28.

Within each column, or string 86, four LED lighting devices 82 are arranged in a line.

The LED lighting devices 82 of each sub-string 80 are interconnected in the same way as described above for the lighting circuit 12, i.e. electrically connected in series between first terminals 24 and the common, central terminal 26, with a further terminal 28 connected in between. As explained above with reference to the different embodiments of one sub-string 88, the LED lighting devices 82 of each sub-string may be controlled fully individually by switching circuits connected to the individual terminals.

Figure 4:
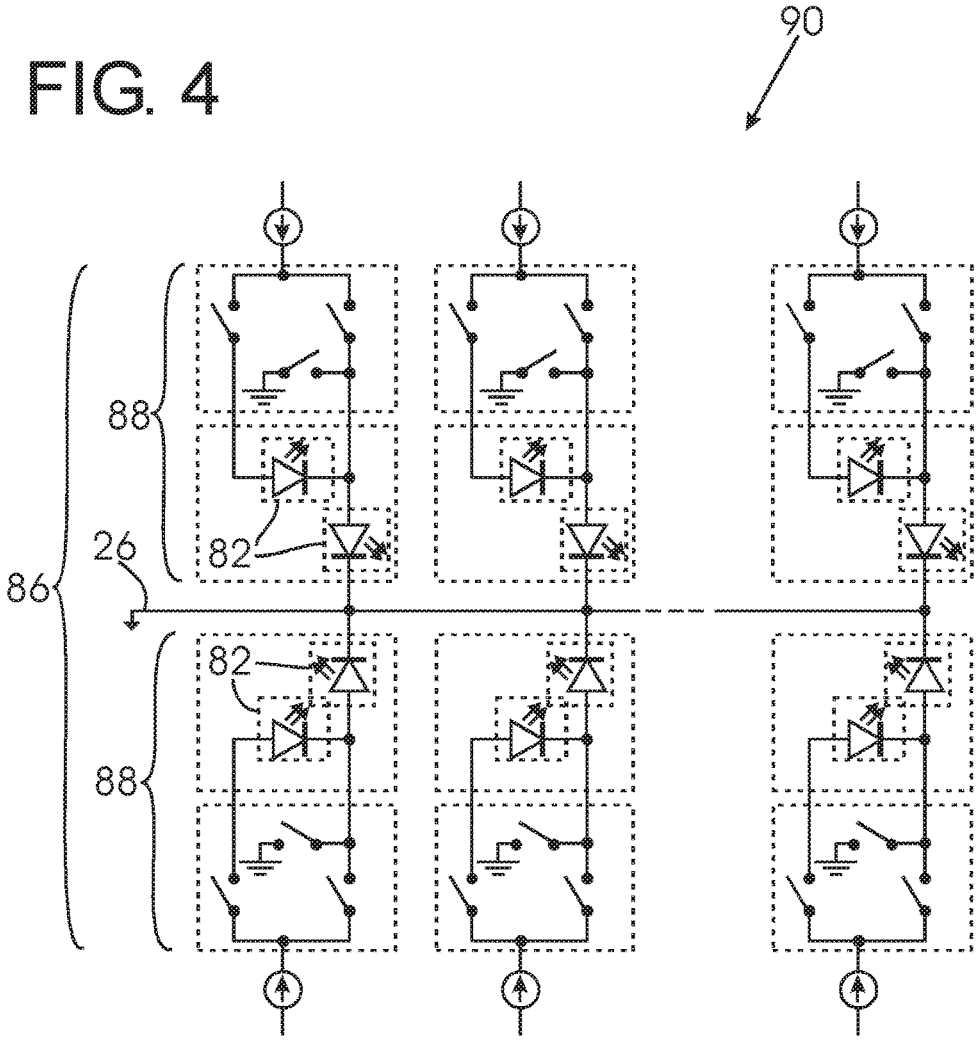
FIG. 4 shows a circuit diagram of a matrix circuit.

FIG. 4 shows a circuit 90 of the matrix arrangement 80 of FIG. 6. Here, each sub-string 88 is configured as a circuit 40 according to FIG. 1*b*, including two LED lighting devices 82 connected in series. Each string 86 of four LED lighting devices 82 arranged in a line is comprised of two symmetrical sub-strings 88 centrally connected to the terminal 26. All strings 86 of the circuit 90 are connected to the same common central terminal 26 as shown both in FIG. 6 and FIG. 4. In the exemplary embodiment shown in FIG. 4, the common central terminal 26 is a ground terminal. If sub-string circuits 88 of different polarity are used, e. g. as shown in FIG. 3*b*, FIG. 3*c*, the common terminal 26 may alternatively be a common supply voltage terminal.

As described above, the LED lighting devices 82 of each sub-string 88 may be individually controlled. Consequently, by providing appropriate switching signals to each sub-string 88, a fully individual activation pattern of each of the LED lighting devise 82 of the matrix 80 may be achieved.

Figure 7:
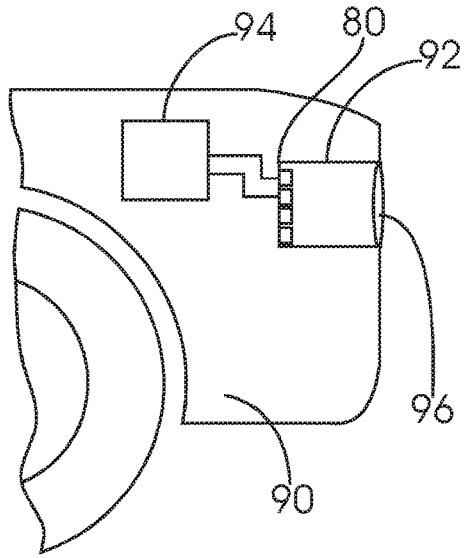
FIG. 7 shows symbolically a front portion of an automobile.

FIG. 7 shows one possible application of a matrix lighting device 80 in a front portion 90 of an automobile. The matrix lighting device 80 with a suitable 4× n-matrix of individually controllable LED lighting devices 82 is installed in a headlamp 92 of the vehicle. A control device 94 is provided to control the activation of the individual LED lighting devices 82 of the matrix lighting device 80. An optical device 96, here schematically shown as a lens, serves to project the light emitted from the LED lighting devices 82 to illuminate the area in front of the vehicle.

By providing multiple LED lighting devices 82 in the 4× n-matrix of the matrix lighting device 80, a high luminous flux of the headlamp 92 may be obtained.

Figure 8:
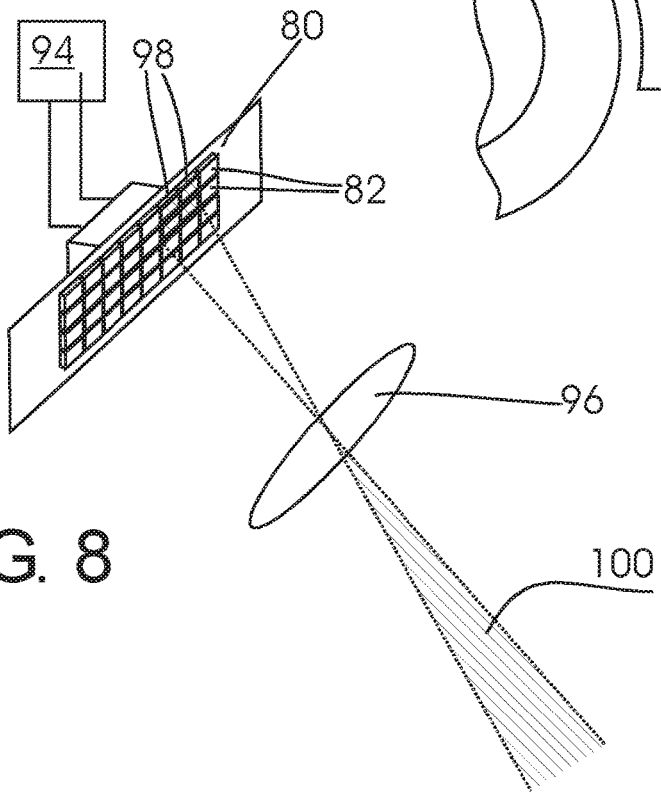
FIG. 8 symbolically shows selective illumination by a matrix of LED lighting devices.

By individual control of the LED lighting devices 82, different illumination patterns of the light emitted from the headlamp 92 may be achieved. FIG. 8 schematically shows a dark zone 100 in the illumination pattern, which is formed by activating all LED lighting devices 82 in the matrix lighting device 80 except for a group 98 of LED lighting devices 82 which are not activated.

The formation of a dark zone 100 as illustrated may be used to obtain different illumination patterns. For example, a high beam illumination pattern may be obtained by activating all LED lighting devices 82, whereas a low beam pattern may be obtained by activating only LED lighting devices from the top rows, projected by the lens 96 into the lower areas in front of the vehicle.

The ability to individually address LED lighting devices 82 also allows adaptive front lighting creating dark zones 100 to prevent glare for pedestrians or other vehicles. The location of such persons and objects may be determined, e.g. by a camera, and the matrix lighting device 80 may be controlled accordingly to create dark zones 100 in the detected locations.

The invention has been illustrated and described in detail in the drawings and foregoing description. Such illustration and description are to be considered illustrative or exemplary and not restrictive; the invention is not limited to the disclosed embodiments.

For example, different embodiments of circuit designs may be used for the disclosed arrangements of LED elements. As explained above for various embodiments, series connection of LED lighting devices may be used with different polarity. The common terminal may be, as explained e. g. with respect to circuits of different polarity in FIG. 3*a*, FIG. 3*b* either a ground terminal or a supply voltage terminal. Both analog and digital circuit designs may be used for generating switching signals. Equally, switching signals may be created by software programs executed on a programmable component, such as a microprocessor. According to the requirements of specific applications, only a single sub-string, or a string comprised of two sub-strings, or a complete matrix of multiple strings may be used. In particular, the dimensions of a 4× n-matrix may be chosen according to specific requirements.

In order to improve the system efficiency, known DC-to-DC converter circuitry, e.g. a buck converter or other topology, may be used to convert an onboard supply voltage of an automobile of e.g. 12V down to a voltage better suited for the sub-strings. If LED lighting devices with multiple LEDs in series are used within the sub-strings, then also higher voltages may be required, since the LED forward voltages add together. In this case, other, upconverting, DC-to-DC converter topologies may need to be implemented, e.g. a boost or buck-boost topology. By means of these circuits, the power loss of the constant current source may be reduced and smaller components may be used for the power supply 16.

Also, instead of the mentioned constant current source power supply, other driving topologies may be used as known to the skilled person.

It should be appreciated that the above described circuits represent simple examples, and that additional components may be added. For example, temperature compensation techniques may be employed, in particular to compensate influences of the change of LED temperatures on the current, luminous flux, colour or other parameters.

Yet, another possibility, known per se to the skilled person, would be a power feedback circuit, disposed to control a DC-to-DC converter to obtain a suitable output voltage as a function of the maximum number of LED lighting devices connected to it in series.

In the claims, the word "comprising" does not exclude other elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. Circuit for operating LED lighting devices, comprising:

a lighting circuit comprising at least a first lighting circuit terminal and a second lighting circuit terminal, and a first and a second LED lighting device electrically connected in series between said first and second lighting circuit terminals;

a third lighting circuit terminal connected between said first and second LED lighting devices;

a power supply with a first and second power supply terminal for delivering electrical power to said LED lighting devices;

a switching circuit comprising at least a first and second switching element, wherein said first switching element is connected between said first power supply terminal and said first lighting circuit terminal, and wherein said second switching element is connected between said first power supply terminal and said third lighting circuit terminal; and a control circuit controlling the switching circuit, the control circuit being configured to individually activate at least one of the first and second LED lighting devices independent from the activation of the other one of the first and second LED lighting devices, said control circuit comprising a logic circuit configured to receive at least a first input signal and a second input signal for controlling said first LED lighting device and said second LED lighting device.

2. Circuit according to claim 1, wherein said switching circuit comprises a third switching element, said third switching element being connected between said second power supply terminal and said third lighting circuit terminal.

3. Circuit according to claim 1, further comprising:

a first sub-string comprising a second lighting circuit and a second switching circuit, said second lighting circuit comprising a third LED lighting device and a fourth LED lighting device, and at least a second sub-string comprising a third lighting circuit and a third switching circuit, said third lighting circuit comprising a fifth LED lighting device and a sixth LED lighting device, wherein lighting circuit terminals of said first and second sub-strings are connected to a common power supply terminal.

4. Circuit according to claim 3, wherein said third and fourth LED lighting devices of said first sub-string and said fifth and sixth LED lighting devices of said second sub-string are arranged in a line.

5. Circuit according to claim 1, wherein a plurality of LED lighting devices including said first and second LED lighting devices are arranged in a matrix forming a plurality of rows and columns of controllable LED lighting devices.

6. Circuit according to claim 5, wherein said matrix comprises at least two parallel columns of LED lighting devices arranged in a line, each of said columns comprising at least two sub-strings each comprising a lighting circuit and a switching circuit according to one of the above claims.

7. Circuit according to claim 6, wherein said second lighting circuit terminals of said lighting circuits of at least two of said columns are connected to a common power supply terminal.

8. Circuit according to claim 1, wherein said power supply is a unipolar power supply.

9. Circuit according to claim 1, wherein said logic circuit is disposed to operate said switching elements depending on the at least first and second input signals such that, when the first switching element is closed, both the first LED lighting device and second LED lighting device are on and, when the second switching element is closed, only the second LED lighting device is on.

10. Circuit according to claim 1, further comprising a third switching element, wherein said logic circuit is disposed to operate said switching elements depending on the at least first and second input signals-such that, when the first switching element is closed, both the first LED lighting device and second LED lighting device are on, when the second switching element is closed, only the second LED lighting device is on, and when the first and third switching elements are closed, only the first LED lighting device is on.

11. Circuit according to claim 1, wherein said logic circuit is comprised of a digital logic circuit or an analog circuit.

12. Circuit of claim 1 wherein the circuit is incorporated in a lighting device, comprising:

an optical means for projecting or reflecting light emitted from said LED lighting devices to form an illumination pattern.

13. Method of operating LED lighting devices, wherein a lighting circuit comprises a first lighting circuit terminal and a second lighting circuit terminal and a first and second LED lighting device electrically connected in series between said first and second lighting circuit terminals, wherein a third lighting circuit terminal is connected between said first and second LED lighting devices, electrical power is supplied to said lighting circuit through a switching circuit, said switching circuit comprising at least a first and second switching element, wherein said first switching element is connected between said first power supply terminal and said first lighting circuit terminal, wherein said second switching element is connected between said first power supply terminal and said third lighting circuit terminal, the method comprising:

controlling the switching circuit by a control circuit, the control circuit being configured to individually activate at least one of the first and second LED lighting devices independent from the activation of the other one of the first and second LED lighting devices, said control circuit comprising a logic circuit configured to receive a first input signal and a second input signal for controlling said first LED lighting device and said second LED lighting device.

* * * * *